United States Patent [19]

Albrecht et al.

[11] Patent Number: 4,658,185

[45] Date of Patent: Apr. 14, 1987

[54] ARRANGEMENT FOR THE IGNITION OF IGNITABLE MIXTURES

[75] Inventors: Hans Albrecht, Waiblingen; Rudolf Maly, Sindelfingen, both of Fed. Rep. of Germany

[73] Assignee: Daimler-Benz Aktiengesellschaft, Stuttgart, Fed. Rep. of Germany

[21] Appl. No.: 664,778

[22] Filed: Oct. 25, 1984

[30] Foreign Application Priority Data

Oct. 25, 1983 [DE] Fed. Rep. of Germany ..... 3338672

[51] Int. Cl.[4] ..... H01J 7/44; H01J 13/46; H01J 19/78; H01J 29/96

[52] U.S. Cl. ..... 315/58; 313/123; 313/124; 313/142; 315/59

[58] Field of Search ..... 315/209 R, 209 T, 58, 315/59, 63, 85; 123/169 MG, 144; 313/123, 124, 142

[56] References Cited

U.S. PATENT DOCUMENTS

| | | | |
|---|---|---|---|
| 3,013,181 | 12/1961 | Marks et al. | 315/58 |
| 3,267,325 | 8/1966 | Why | 315/58 |
| 4,004,562 | 1/1977 | Rado et al. | 315/58 |
| 4,308,487 | 12/1981 | Feaster | 315/59 |
| 4,345,179 | 8/1982 | Asai et al. | 315/58 |
| 4,456,960 | 6/1984 | Toyoshima et al. | 315/58 |
| 4,549,114 | 10/1985 | Herden | 315/59 |

*Primary Examiner*—David K. Moore
*Assistant Examiner*—M. Razavi

[57] ABSTRACT

An arrangement for the ignition of ignitable mixtures, especially a spark plug for producing sparks in otto-engines, which is constructed according to high-frequency standpoints and in which at least one condenser arranged in the spark plug is adapted to be charged to a high voltage and is adapted to be discharged as much as possible exclusively in the breakdown phase of the starting phase of the ignition spark by way of a booster gap also arranged in the spark plug and a main gap formed by an ignition electrode with respect to a ground electrode, whereby the breakdown voltage of the booster is higher than the breakdown voltage at the main gap. In particular, for achieving a compact constructive form, satisfactory from a manufacturing point of view, and for optimizing the ignition and flame development, the condenser and the main gap are connected in a series circuit in a preferred embodiment of the invention, with respect to which the booster gap is connected in parallel.

38 Claims, 7 Drawing Figures

ARRANGEMENT FOR THE IGNITION OF IGNITABLE MIXTURES

Figure 1A:
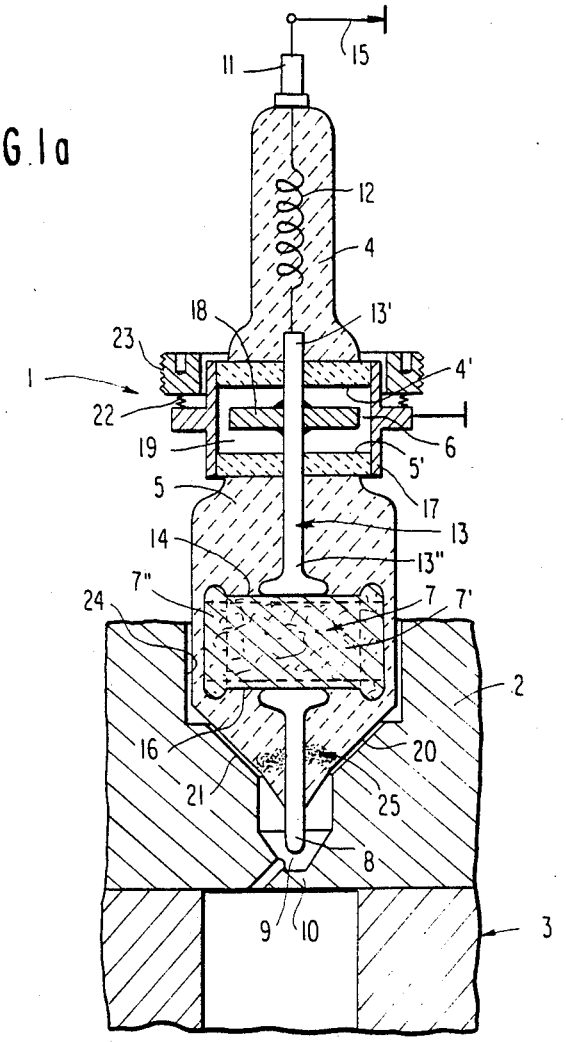

The present invention relates to an arrangement for the ignition of ignitable mixtures, especially to a spark plug for producing ignition sparks in Otto-engines.

An arrangement for the ignition of ignitable mixtures of the aforementioned type is already known (German Auslegeschrift No. 28 10 159), especially a spark plug for producing the ignition sparks in Otto-engines, in which a condenser is adapted to be charged to a high voltage and is adapted to be discharged as much as possible exclusively in the breakdown phase of the starting phase of the ignition spark by way of a booster gap and ignition electrodes (main ignition gap), whereby the breakdown voltage of the booster gap is higher than the breakdown voltage at the ignition electrodes and the overall construction of the spark plug takes place according to maximum frequency point of view, which means, inter alia, that the feed lines and the booster gap have ohmic resistances and inductive impedances which are as small as possible at frequencies greater than 50 MHz, that a dielectric having as high as possible a dielectric constant with lowest possible loses in the frequency range greater than 50 MHz is provided as dielectric of the condenser, that the surge impedance in all partial sections of the spark plug is as small as possible (much smaller than 50 ohms) and that jumps in the surge resistance are avoided, and that the functioning elements, such as spark gaps and condenser, are integrated into the spark plug.

In comparison to customary spark plugs, the energy release is achieved with this spark plug in the breakdown phase of the starting phase, whereby the booster spark gap and the main spark gap are connected in a series circuit, with which the condenser is connected in parallel. This arrangement, however, entails a relatively large structural form, for example, by the use of a tubular condenser, and, on the other, still renders a technical realization and rational manufacture relatively costly.

Starting from an ignition arrangement of the aforementioned type, the present invention is concerned with the task to construct the arrangement more compact in its structural form and more favorable from a manufacturing point of view, with simultaneous further optimization of the ignition and of the flame development. This task is of significance in particular with a view toward the realization of a spark plug having a long length of life.

The underlying problems are solved according to the present invention in that the condenser and the main spark gap are in a series circuit, with which the booster spark gap is connected in parallel, whose other electrode is connected with ground. In the alternative, the condenser and the main spark gap are connected in a series circuit, whereby the free connection of the condenser and one electrode of the booster spark gap are connected with the high-voltage source of first polarity and one connection of a second condenser and the other electrode of the booster gap are connected with a high-voltage source of a second polarity, whereas the other connection of the second condenser is connected with ground.

By reason of the series connection of the main spark gap and of the condenser, it is achieved, on the one hand, that the condenser can be constructed as disc capacitor, as a result of which a higher energy storage density is possible and, on the other hand, is it achieved that a galvanic separation between the high-voltage side and the main spark gap takes place automatically. A compact structural form and a construction satisfactory for manufacture result therefrom and from the series connection, and an improvement of the ignition is attained by the higher energy storage density. Furthermore, the condenser acts at the same time as interference suppressing condenser so that interference suppressing measures are integrated into the spark plug in an advantageous manner.

If the other electrode of the booster gap is connected with ground, the further advantage is achieved that all high-frequency interferences occurring within the spark plug area are counteracted more independently of frequency by the short-circuited booster gap than with an interference suppression by means of the condenser in the known prior art arrangement. By the use of two condensers and the feed thereof from high-voltage sources of different polarity, a voltage division is achieved, as a result of which the high voltages are more easily controlled both in the spark plug as also on the high-voltage side.

If the ground electrode of the main spark gap is formed by the cylinder head or the piston top of the engine, the heretofore customary metallic spark plug base can be dispensed with, as a result of which a stronger insulation and thus also a greater high-voltage dielectric strength is achieved with the same structural size.

With a construction of the condensers as two-layer condensers with predetermined dielectric constants and with the possibility of the use of a disc condenser having a low inductance, on the one hand, a better high-voltage dielectric strength with respect to ground is achieved and, on the other a still more compact construction is realized by reason of the higher energy storage density.

By constructing the booster gap as annular spark gap, on the one hand, a greater length of life of the spark plug is assured by the larger electrode surfaces—made possible by the construction of the spark plug in accordance with the present invention—and on the other, a compact construction, a design correct from a manufacturing point of view and a cathode sputtering protection are achieved.

By the arrangement of the booster gap to the main gap according to the present invention, the booster gap can be constructed also in a simple manner if the booster gap is composed of several electrode gaps and in particular if booster gap is adapted to be switched by way of a trigger gap adapted to be switched by a trigger pulse so that the booster gap can be combined additionally with a trigger spark gap.

Advantageous embodiments of the spark plug can be realized if the outer ring shaped electrode of the booster gap mechanically connects the ceramic insulator and spark plug housing and spaces the same at a predetermined axial distance, if the high-voltage connection and a part of the free connection of the condenser constructed as condenser feed are arranged in the ceramic insulator whereas the other part of the condenser feed is arranged in the spark plug housing bridging the spacing and is electrically conductively connected with the condenser arranged also in this spark plug housing, if additionally the ignition electrode is arranged in the spark plug housing and, on the one hand, is electrically connected with the other connection of the condenser and, on the other, projects out of the spark plug housing, and in that furthermore the inner disc-shaped electrode of the booster gap is electrically conductively arranged in the space formed by the spacing between ceramic insulator and spark plug housing on the condenser feed side. A particularly simple type of fastening is achieved if the spark plug housing is provided within the area of the ignition electrode with a conical seat tapering in the direction toward the ignition electrode and for centering the spark plug in the engine, in which the spark plug is fastened by means of an externally threaded ring arranged on the insulator respectively on the electrode or on the ground ring. An extremely low internal resistance and thus a high thermal value is achieved within this area by the position and arrangement of the conical seat and the construction of the spark plug housing within this area and additionally by the use of a condenser serving for the ignition, as a result of which an extreme shunt insensitivity is realized.

A further increase of the high-voltage dielectric constant can be achieved according to a further feature of the present invention if the surfaces of ceramic insulator and ceramic spark plug housing which are located in the space formed by the spacing between ceramic insulator and spark plug housing, are glazed. The surface leakage path and the inductivity for undesired creep discharges can be increased if according to another feature of the present invention the spark plug housing is provided between its conical seat and its end on the side of the ignition electrode with grooves extending in the circumferential direction whereas it is provided with a smooth surface at its end face. In an advantageous manner, these grooves form at the same time turbulence chambers when the spark plug is installed into the engine so that a safe scavenging during the inlet phase is assured also in this area.

For a rational series production according to the present invention, the individual parts of the spark plug are connected with each other preferably in accordance with glass-soldering techniques whereby also several successive glass layers can be used for better material matching.

By the construction of the spark plug in accordance with the present invention, especially also with a condenser of high-energy storage density, it is additionally possible to produce several ignition pulses and thus discharges with an equal overall energy within the period of time of an ignition operation having a duration as is customary with prior art spark plugs, which has as a consequence a higher ignition realiability with eventually unfavorable mixture preparation (non-homogeneities in the mixture).

These and other objects, features and advantages of the present invention will become more apparent from the following description when taken in connection with the accompanying drawing which shows, for purposes of illustration only, several embodiments in accordance with the present invention, and wherein:

FIG. 1*a* is a cross-sectional view through a first embodiment of a spark plug in accordance with the present invention.

Figure 1B:
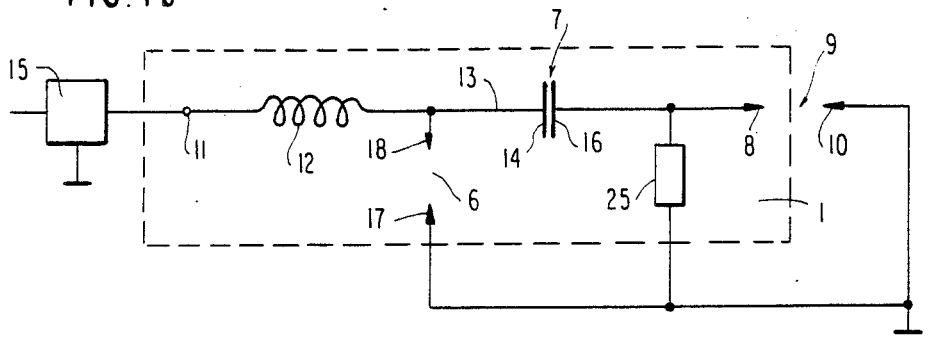

FIG. 1*b* is the equivalent electric circuit for the spark plug of FIG. 1*a*.

Figure 2:
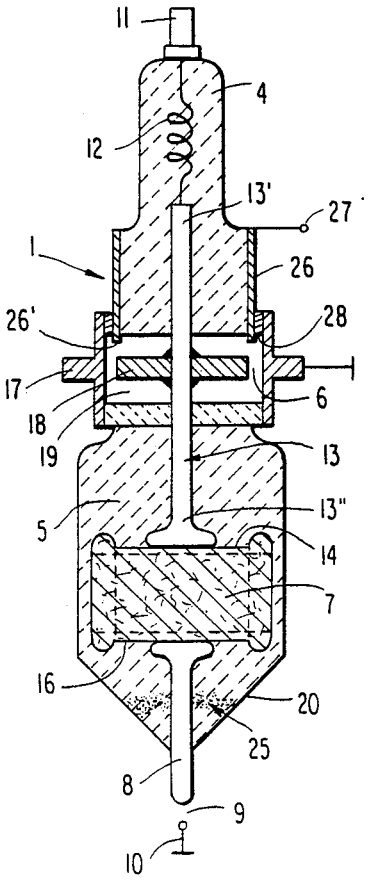

FIG. 2 is a cross-sectional view through the spark plug illustrated in FIG. 1*a*, however, with a triggerable booster gap in accordance with the present invention.

Figure 3A:
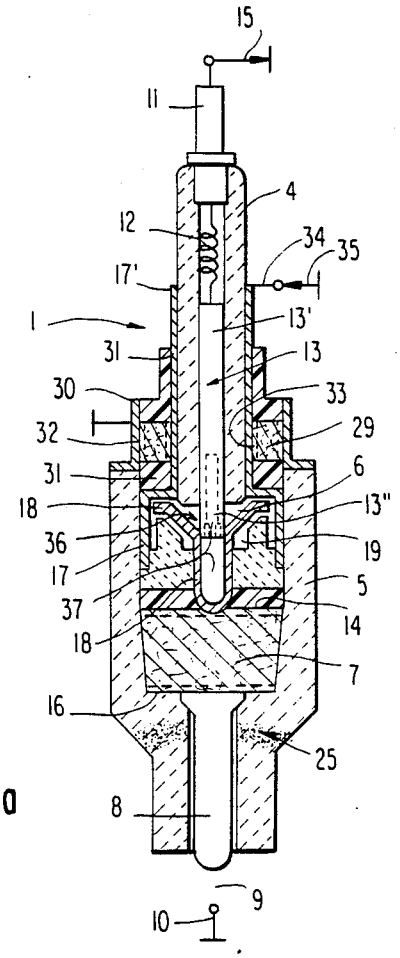

FIG. 3*a* is a cross-sectional view through a further embodiment of a spark plug in accordance with the present invention.

Figure 3B:
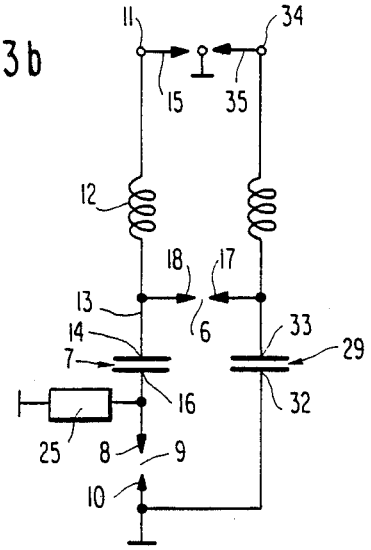

FIG. 3*b* is the equivalent electric circuit for the spark plug of FIG. 3*a*.

Figure 3C:
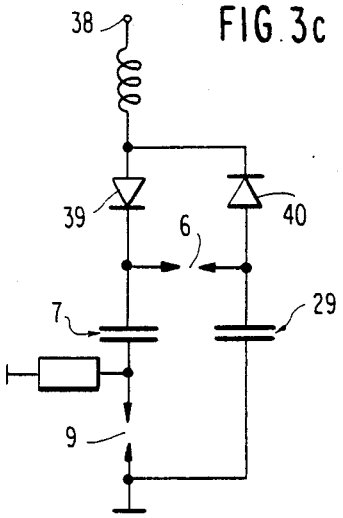
Figure 4:
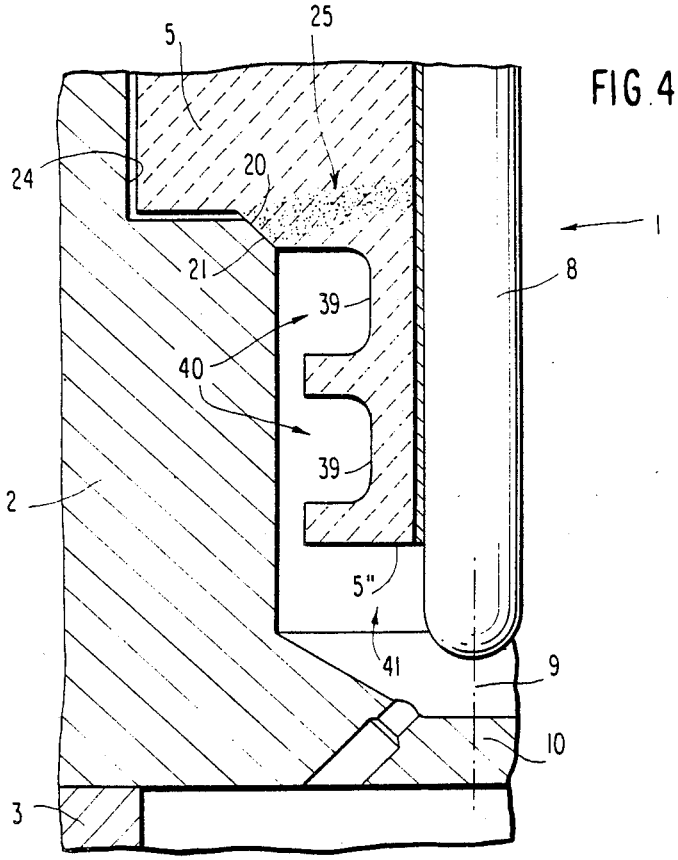

FIG. 3*c* is an alternative equivalent electric circuit for the spark plug of FIG. 3*a*, and FIG. 4 is a partial cross-sectional view, on an enlarged scale, illustrating a partial area of an installed spark plug in accordance with the present invention.

Referring now to the drawing wherein like reference numerals are used throughout the various views to designate like parts, and more particularly to FIG. 1*a*, the spark plug generally designated by reference numeral 1 is schematically illustrated in this figure in its condition installed in the cylinder head 2 of the engine generally designated by reference numeral 3. The spark plug 1 consists mechanically primarily of the ceramic insulator 4, of the spark plug housing 5, of the booster gap 6, of the disc condenser 7 and of the ignition electrode 8, electrically viewed also of the main spark gap 9 and of the ground electrode 10 formed by the cylinder head 2, which may also be constructed in the customary known matter—for example, as described in the German Auslegeschrift No. 28 10 159. The free connection 14 of the condenser 7 arranged in the spark plug housing 5 is connected with the high-voltage source 15 by way of a high-voltage connection 11, an inductive impedance 12 and a condenser feed 13 arranged in the ceramic insulator 4, whereas the other connection 16 of the condenser 7 is connected with the ignition electrode 8 also arranged in the spark plug housing. Of the booster gap 6 constructed as annular spark gap, the outer ring shaped electrode 17 connects the ceramic insulator 4 mechanically with the spark plug housing 5 while maintaining a certain axial spacing, whereas the inner disc-shaped electrode 18 is arranged on the condenser feed 13 in the preferably gas-tight space 19 formed by the spacing between ceramic insulator 4 and spark plug housing 5 and is electrically conductively connected with the condenser feed 13. The condenser feed 13 is thereby arranged with one portion 13' in the ceramic insulator 4 and with the other portion 13'' in the spark plug housing 5 so that the condenser feed 13 itself bridges the spacing between ceramic insulator 4 and spark plug housing 5. The spark plug housing 5, also made of ceramic material, is provided within the area of the ignition electrode 8 with a conical seat 20 tapering in the direction toward the ignition electrode end; the conical seat 20 thereby form-lockingly corresponds with a conical mounting 21 in a cylinder head bore 24 in the cylinder head 2 and centers and fixes the spark plug in the engine. The spark plug 1 is held in the axial direction by an externally threaded ring 23 supported on the electrode 17 by way of a spring 22, whereby the threaded ring 23 is screwed into the cylinder head 2. The matching of the spatial arrangement of the conical mounting 21 to the conical seat 20 is thereby made in such a manner that, on the one hand, with an installed spark plug 1 the ignition electrode 8 thereof has a predetermined distance to the ground electrode 10 representing the main spark gap 9 and, on the other, a good heat conductivity (=high heat value) to the cylinder head 2 is assured by way of the ignition electrode 8 and the conical seat 20, which corresponds in conventional spark plugs to a short insulator base. Furthermore, the outer diameter of the outer electrode 17 of the booster gap 6 is so chosen that with an installed spark plug 1, the electrode 17 electrically conductingly contacts the wall of the cylinder head bore 24 of the cylinder head 2 forming the ground connection. For purposes of improving the high-voltage dielectric strength, the surface 4' of the ceramic insulator 4 and the surface 5' of the spark plug housing 5 which are located in the space 19, are thereby glazed. In a particularly advantageous manner, the condenser 7 is cast into the spark plug housing 5 or glazed into the same; for purposes of increasing the high-voltage dielectric strength and the energy-storage density, the disc condenser 7 may be constructed as two-layer condenser with an inner layer 7' and with an outer ring shaped layer 7'' whereby the dielectric constant $\epsilon_2$ of the outer layer 7'' is smaller than the dielectric constant $\epsilon_1$ of the inner layer 7'.

The constructive arrangement illustrated in FIG. 1*a* of the spark plug arrangement is represented in FIG. 1*b* in the form of an equivalent electric circuit diagram, whereby it can be seen in particular that the condenser 7 and the main spark gap 9 are connected in a series circuit, with respect to which the booster gap 6 is connected in parallel.

The operation of the arrangement according to the present invention is now as follows. A high-voltage source 15 fed from a battery—for example, a high-voltage condenser ignition system—is connected with the high-voltage connection 11 of the spark plug 1, by way of which a high-voltage pulse is applied during the ignition instant by way of an ignition pulse in a corresponding distributor position coordinated to the spark plug. The condenser 7 thereby charges up by way of the inductive impedance 12, the condenser feed 13 and a charging resistance 25. The charging resistance 25 can thereby be formed by the conductive construction of the spark plug housing 5 within the area between the ignition electrode 8 and the surface of the conical seat 20, for example, by doping the volume or the surface by admixture of metal oxides, so that this charging resistance is located, viewed electrically, between the ignition electrode 8 and the ground electrode 10. At the same time, this high voltage is also applied to the inner electrode 18 of the booster spark gap 6 which—as soon as the applied voltage has reached the breakdown voltage—breaks down. A conductive connection results thereby between the inner electrode 18 and outer electrode 17 connected to ground so that the voltage present at the condenser 7 also is present at the ignition electrode 8 of the main spark gap 9 and the latter breaks down in the direction toward the ground electrode 10. Very high currents thereby flow by way of the main spark gap whereas simultaneously the condenser voltage collapses. This process lasts a few ns. During this short time, however, the entire electric energy is removed from the condenser 7 up to the discharge thereof so that the entire energy release takes place in the breakdown phase of the starting phase of the ignition spark and thus an optimum flame-development realibility of the fuel-air mixture is achieved.

The spark plug illustrated in FIG. 2 represents an alternative construction of the spark plug according to FIG. 1*a*, and more particularly as the booster spark gap 6 is now additionally also triggerable. For this purpose, a ring-shaped trigger electrode 26 with a voltage connection 27 is arranged coaxially on the ceramic insulator 4, which extends with its ring-shaped electrode end 26' facing the spark plug housing 5 through the ceramic insulator 4 and projects into the space 19. As a result thereof, this electrode 26 forms together with the electrode 17 which at the same time is the outer electrode of the booster spark gap 6, a trigger spark gap 28. In contrast to the construction according to FIG. 1*a*, the booster gap 6 in the embodiment according to FIG. 2 does not already break down during the application of the high-voltage pulse to the high-voltage connection 11 but instead the breakdown voltage thereof is now slightly higher than the maximum of the high-voltage pulse so that only when the trigger electrode 26 has also received a voltage pulse at the ignition instant by way of an ignition pulse generator and starts to ignite toward the electrode 17, also the booster gap 6 can break down and consequently the process described by reference to FIG. 1*a* may take place.

In FIG. 3*a* the spark plug 1 is illustrated schematically and in a condition not installed in the cylinder head of the engine. As regards the installation, however, the same is true as said in connection with FIG. 1*a*. The spark plug 1 again consists mechanically primarily of the ceramic insulator 4, of the spark plug housing 5, of the booster spark gap 6, of the disc condenser 7 and of the ignition electrode 8, and electrically viewed, additionally of the main spark gap 9 and of the ground electrode 10 formed by the cylinder head or the engine which again may be constructed in the customary known manner—for example, as described in German Auslegeschrift No. 28 10 159. Differing from the embodiment of FIG. 1*a*, the spark plug according to FIG. 3*a* includes additionally a ring condenser 29 which is integrated into the assembly of the spark plug as will be described more fully hereinafter. The free connection 14 of the first condenser 7 arranged in the spark plug housing 5 is connected with the first high-voltage source 15 by way of a first high-voltage connection 11, an inductive impedance 12 and a condenser feed 13 arranged in the ceramic insulator 4, whereas the other connection 16 of the condenser 7 is connected with the ignition electrode 8 also arranged in the spark plug housing 5. Of the booster spark gap 6 constructed as annular spark gap, the outer, ring-shaped electrode 17 connects the ceramic insulator 4 mechanically with the spark plug housing 5 while maintaining a predetermined axial spacing whereas the inner disc-shaped electrode 18 is arranged on the condenser feed 13 within the preferably gas-tight space 19 formed by the spacing between ceramic insulator 4 and spark plug housing 5, and is electrically conductively connected with the same. The condenser feed 13 is thereby arranged with a portion 13' thereof in the ceramic insulator 4 and terminates with its other portion 13'' in a pot-shaped extension 18' of the inner electrode 18 which, in its turn, establishes the electrically conductive connection between condenser feed 13 and condenser connection 14 so that also the inner electrode is part of the condenser feed. On the outer ring-shaped electrode 17, the annular condenser 29 is arranged on the portion 17' surrounding the ceramic insulator 4; the annular condenser 29, in turn, is surrounded by a ground ring 30. The ring condenser 29 and the ground ring 30 are thereby fixed with respect to the electrode 17 and the spark plug housing 5, for example, by means of the sealing compound 31. Whereas the ground ring 30 is electrically conductively connected with the connection 32 of the condenser 29, the other connection 33 of the ring condenser 29 is conductively connected with the part 17' of the outer electrode 17 of the booster gap which is connected by way of a high-voltage connection 34 with a second high-voltage source 35. The arrangement and installation of the spark plug in the engine may take place as described by reference to FIG. 1*a*.

The constructive assembly of the arrangement illustrated in FIG. 3*a* is represented in FIG. 3*b* in the form of an equivalent electric circuit diagram and the operation of the arrangement is as follows: The high-voltage connection 11 of the spark plug 1 is connected with a high-voltage source 15 of a first polarity and the high-voltage connection 34 is connected with a high-voltage source 35 of the second polarity—whereby, for example, a high-voltage condenser ignition system serves as high-voltage source which is fed with alternating current from an alternator—whereby at the ignition instant high-voltage pulses of opposite polarity and of equal or different magnitude are applied from an ignition pulse generator by way of these connections at a corresponding instant coordinated to the spark plug. The condenser 7 thereby charges by way of the inductive impedance 12 and the condenser feed 13 and also the condenser 29 charges up by way of the outer electrode 17 (17') of the booster gap 6. At the same time, these high-voltage pulses also are present at the two electrodes 17 and 18 of the booster gap 6 which—as soon as the sum of the two applied voltages has reached the breakdown voltage—breaks down. A conductive connection results thereby between the inner electrode 18 and the outer electrode 17 so that the condensers 7 and 29 are connected in series and the sum of their voltages is also applied to the ignition electrode 8 of the main gap 9 whereupon the same breaks down in the direction toward the ground electrode 10. By the use of two condensers and the feed thereof from high-voltage sources of different polarities, a voltage division is effected for the charging, so that the high-voltage side can be dimensioned correspondingly weaker whereas during the discharge a voltage multiplication corresponding to the sum of the two condenser voltages is achieved by the corresponding circuit connection of the condensers.

By reason of the fact that the inner-cathodic electrode 18 is surrounded by the outer-anodic-electrode 17 in a hollow cylindrical manner, the electrode 17 acts as cathode-sputtering protection so that notwithstanding the deposit of electrode material of the electrode 18 at the electrode 17, a defined booster gap 6 remains preserved. With a view to maintaining constant conditions at the booster gap 6, it is additionally advantageous if at least one electrode is connected by way of venting holes with a venting or breathing space. In the illustrated embodiment, the inner electrode 18 is provided thereby with several venting openings 36 distributed over the circumference within the area, in which it surrounds the condenser feed and is connected with the same, whereas the condenser feed 13 is provided with a dead-end bore so that the latter and pot-shaped extension 17' of the electrode 18 form a breathing-space.

Whereas according to FIGS. 3*a* and 3*b*, the spark plug is constructed with two high-voltage connections 11 and 34, it is also possible—as illustrated in FIG. 3*c*—to feed the spark plug by way of an a.c. high-voltage source 38 whose voltage half waves are to be rectified by electric valves or diodes 39 and 40 and to apply the rectified voltages to the condensers 7 and 29 and the booster gap 6.

Since in the booster gap-condenser arrangement according to the present invention the ignition spark energy is released exclusively during the breakdown phase of the starting phase of the ignition spark, which lasts with respect to time only a fraction of the time of an ignition process as obtained with the heretofore customary spark plug (about 2 ms)—during which the ignition spark energy is released, it is possible to produce within this period of time several ignition sparks—however, with the same overall ignition spark energy—as a result of which a higher ignition reliability is achieved with eventually unfavorable mixture preparation.

FIG. 4 illustrates on an enlarged scale a partial area of an installed spark plug 1, whereby in particular the installation arrangement and the spark plug face are of significance. As can be seen from this figure, the spark plug housing 5 is provided between its conical seat 20 and its end on the side of the ignition electrode with grooves 39 extending in the circumferential direction (or annular grooves) which form at the same time turbulence chambers 40 with respect to the wall of the cylinder head bore 24. As a result of this type of construction of the spark plug within this area, it is achieved, on the one hand, that the leakage path between conical seat 20 and electrode 8 and the inductivity are increased so that undesirable leakage discharges can be effectively counteracted, and on the other hand, that during the inlet phase this area is effectively scavenged by the turbulence production. In contrast thereto, the end face 5'' of the spark plug housing 5 is provided with a smooth surface so that an auxiliary chamber 41 which is intentionally kept calm, results from this smooth surface 5'', the electrode and the smooth wall of the bore 24, which can also become effective during the inlet phase owing to the supersonic flow. Altogether, a constancy during the ignition and flame development of the mixture is achieved by these measures.

In the preferred manner, the condensers 7 and 29 are made of ceramic material with the designation KER 310 to 331 and KER 340 to 351 of the company Rosenthal (DE).

While we have shown and described several embodiments in accordance with the present invention, it is understood that the same is not limited thereto but is susceptible of numerous changes and modifications as known to those skilled in the art and we, therefore, do not wish to be limited to the details shown and described therein but intend to cover all such changes and modifications as are encompassed by the scope of the appended claims.

We claim:

1. An arrangement in a spark plug for producing ignition sparks to ignite ignitable mixtures, said arrangement comprising at least one condenser means operable to be charged by a high-voltage source, booster gap means and main gap means having respective electrodes, said main gap means including an ignition electrode and a ground electrode, said condenser means being operable to be substantially discharged during the breakdown phase of initial ignition of said spark plug through said booster gap means and main gap means, the breakdown voltage of the booster gap means being higher than the breakdown voltage of the main gap means, a free connection of said condenser means and one electrode of the booster gap means adapted to be connected with the high-voltage source, the condenser means and the main gap means being connected in series circuit, and the booster gap means being connected in parallel with said series circuit and ground.

2. An arrangement in a spark plug for producing ignition sparks to ignite ignitable mixtures, said arrangement comprising a first condenser means operable to be charged by a high-voltage source of a first polarity, booster gap means and main gap means having respective electrodes, said main gap means including an ignition electrode and a ground electrode, said first condenser means being operable to be substantially discharged during the breakdown phase of initial ignition of said spark plug through said booster gap means and main gap means, the breakdown voltage of the booster gap means being higher than the breakdown voltage of the main gap means, said first condenser means and the main gap means being connected in a series circuit, a free connection of said first condenser means and one electrode of the booster gap means adapted to be connected with said high-voltage source of a first polarity, a second condenser means having respective connections, one connection of said second condenser means and one electrode of the booster gap means being operable to be connected with a high-voltage source of a second polarity, and the other connection of said second condenser means being operatively connected with ground.

3. An arrangement according to claim 1, wherein the ground electrode of the main gap means is formed by one of cylinder head and piston top of the engine.

4. An arrangement according to claim 1, wherein said condenser means is constructed as disc condenser with low inductance.

5. An arrangement according to claim 2, wherein said second condenser means is constructed as ring condenser.

6. An arrangement according to claim 5, wherein each said condenser means are made of ceramic material.

7. An arrangement according to claim 4, wherein the condenser means is constructed as two-layer condenser, the dielectric constant of the ring shaped outer layer being different than the dielectric constant of the inner layer.

8. An arrangement according to claim 7, wherein the first mentioned dielectric constant is larger than the second mentioned dielectric constant.

9. An arrangement according to claim 7, wherein the first mentioned dielectric constant is smaller than the second mentioned dielectric constant.

10. An arrangement according to claim 7, wherein the first mentioned dielectric constant continuously passes over into the second mentioned dielectric constant.

11. An arrangement according to claim 2, wherein said first condenser means and said second condenser means are charged from their respective high-voltage source to a different voltage level and with opposite polarity.

12. An arrangement according to claim 2, wherein the first condenser means and the second condenser means are charged from their respective high-voltage source to the same voltage level of opposite polarity.

13. An arrangement according to claim 1, wherein the booster gap means is constructed as annular gap including an outer electrode and an inner electrode, the inner electrode being operatively connected with the free connection of the condenser means, which is constructed as condenser feed.

14. An arrangement according to claim 13, wherein the inner electrode is part of the condenser feed.

15. An arrangement according to claim 10, wherein the inner cathodic electrode of the booster gap means is surrounded ring shaped by the outer anodic electrode as sputter protection.

16. An arrangement according to claim 2, wherein the outer electrode of the booster gap means is constructed as voltage feed and at the same time as condenser connection for the second condenser means.

17. An arrangement according to claim 1, wherein the booster gap means includes several electrode spark gaps.

18. An arrangement according to claim 17, wherein the booster gap means is adapted to be switched by way of a trigger spark gap switchable by a trigger pulse.

19. An arrangement according to claim 17, wherein one of the several electrode spark gaps is constructed as trigger spark gap for the booster gap means.

20. An arrangement according to claim 13, wherein at least one of the inner and outer electrode of the booster gap means is connected with a breather space by way of venting openings.

21. An arrangement according to claim 13, wherein the outer electrode of the booster gap means mechanically connects a ceramic insulator means of the spark plug with a spark plug housing means also made of ceramic material.

22. An arrangement according to claim 21, wherein the outer ring-shaped electrode of the booster gap means is spaced apart from the ceramic insulator means and the spark plug housing means by a predetermined axial spacing and mechanically connects the same, the high-voltage connection and a portion of the free connection of the condenser means is constructed as condenser feed being and arranged in the cermic insulator means whereas the other portion of the condenser feed is arranged in the spark plug housing means bridging the spacing and is electrically connected with the condenser means arranged in the spark plug housing means, the ignition electrode being arranged in the spark plug housing means and being, on the one hand, electrically connected with the other connection of the condenser means and, on the other hand, projecting out of the spark plug housing means, and the inner disc-shaped electrode of the booster gap means being electrically conductively arranged on the condenser feed within the space formed by the spacing between the ceramic insulator means and the spark plug housing means.

23. An arrangement according to claim 2, wherein the booster gap means is constructed as annular gap including an outer electrode and an inner electrode, the inner electrode being operatively connected with the free connection of the condenser means, which is constructed as condenser feed.

24. An arangement according to claim 23, wherein the outer electrode of the booster gap means mechanically connects a ceramic insulator means of the spark plug with a spark plug housing means also made of ceramic material.

25. An arrangement according to claim 24, wherein the outer ring-shaped electrode of the booster gap means is spaced apart from the ceramic insulator means and the spark plug housing means by a predetermined axial spacing and mechanically connects the same, a tubularly shaped portion of said outer ring-shaped electrode which surrounds the ceramic insulator means being electrically connected with one connection of the second condenser means constructed as annular condenser and arranged on the tubularly shaped portion which is constructed as a second high-voltage connection, a metallic ring electrically connected with the outer connection of the ring condenser and serving as ground connection, a first high-voltage connection and a portion of the free connection of the first condenser means which is constructed as condenser feed, being arragned in the ceramic insulator means while the other portion of the condenser feed is aranged in the spark plug housing means bridging the spacing and being electrically connected with the first-mentioned condenser means arranged in the spark plug housing means, the ignition electrode being arranged in the spark plug housing means and being, on the one hand, electrically connected with the other connection of the first condenser means and, on the other, projecting out of the spark plug housing means, and the inner disc-shaped electrode of the booster gap means being arranged electrically conductively on the condenser feed within the space formed by the distance between ceramic insulator means and the spark plug housing means.

26. An arrangement according to claim 24, wherein the outer ring-shaped electrode of the booster gap means is spaced apart from the ceramic insulator means and the spark plug housing means by a predetermined axial spacing and mechanically connects the same, the high-voltage connection and a portion of the free connection of the first mentioned condenser means, which is constructed as condenser feed, being arranged in the ceramic insulator means, whereas the other portion of the condenser feed is arranged in the spark plug housing means bridging the spacing and being electrically connected with the first condenser means arranged in the spark plug housing means, the ignition electrode being arranged in the spark plug housing means and, on the one hand being electrically connected with the other connection of the first condenser means and, on the other, projecting out of the spark plug housing means, trigger gap means having trigger electrodes, the inner disc-shaped electrode of the booster gap means arranged electrically conductively on the condenser feed as one trigger electrode of the trigger gap means being arranged in the space formed by the spacing between ceramic insulator means and the spark plug housing means, the outer electrode of the trigger means being formed by the outer ring-shaped electrode of the booster gap means.

27. An arrangement according to claim 21, wherein the spark plug housing means is provided within the area of the ignition electrode with a conical seat tapering in the direction toward the ignition electrode end for centering the spark plug in the engine, the spark plug being secured in the conical seat by means of an externally threaded ring arranged on one of insulator means, the other electrode of the booster gap means and a ground ring.

28. An arrangement according to claim 27, wherein the spark plug housing means is constructed in a heat-conducting and electrically-conducting manner within the area of the ignition electrode between the latter and the surface of the conical seat.

29. An arrangement according to claim 21, wherein the surfaces of the ceramic insulator means and of the ceramic spark plug housing means which are located in the space formed by the spacing between ceramic insulator means and spark plug housing means, are glazed.

30. An arrangement according to claim 21, wherein the ceramic insulator means, the outer electrode of the booster gap means, the condenser means and the spark plug housing means are connected with each other by glass soldering and are of at least one-layer construction.

31. An arrangement according to claim 21, wherein the ceramic insulator means, the outer electrode of the booster gap means, the condenser means and the spark plug housing means are connected with each other by a multi-layered construction.

32. An arrangement according to claim 21, wherein the spark plug housing means is provided between its conical seat and its end on the side of the ignition electrode with grooves extending in the circumferential direction whereas it is provided at its end face with a smooth surface.

33. An arrangement according to claim 32, wherein said grooves form simultaneously turbulence chambers with the spark plug installed in the engine.

34. An arrangement according to claim 21, wherein the space of the booster gap means formed by the distance between the ceramic insulator means and the spark plug housing means is filled with gas.

35. An arrangement according to claim 34, wherein said gas is nitrogen.

36. An arrangement according to claim 2, wherein the ground electrode of the main gap means is formed by one of cylinder head and piston top of the engine.

37. An arrangement according to claim 2, wherein said first condenser means is constructed as disc condenser with low inductance.

38. An arrangement according to claim 6, wherein each condenser means is constructed as two-layer condenser, the dielectric constant of the ring shaped outer layer being different than the dielectric constant of the inner layer.

* * * * *